US006663239B2

(12) United States Patent
Wotton et al.

(10) Patent No.: US 6,663,239 B2
(45) Date of Patent: Dec. 16, 2003

(54) MICROWAVE APPLICATOR FOR INKJET PRINTER

(75) Inventors: Geoff Wotton, Battle Ground, WA (US); Michael F. Klopfenstein, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/003,792

(22) Filed: Oct. 31, 2001

(65) Prior Publication Data

US 2003/0081098 A1 May 1, 2003

(51) Int. Cl.[7] ..... B41J 2/01
(52) U.S. Cl. ..... 347/102
(58) Field of Search ..... 347/102, 101, 347/104, 105, 106, 107, 43, 4, 95, 85; 399/320; 346/25; 219/216; 101/488; 34/304, 381; 516/70; 8/471; 241/34, 38, 36, 46.016

(56) References Cited

U.S. PATENT DOCUMENTS

| | | | |
|---|---|---|---|
| 3,950,650 | A | 4/1976 | Pray et al. |
| 4,072,099 | A | 2/1978 | Martin |
| 4,075,143 | A | 2/1978 | Schelhaas et al. |
| 4,089,123 | A | 5/1978 | Ericsson et al. |
| 4,839,142 | A | 6/1989 | Charm |
| 4,903,082 | A | 2/1990 | Dyer et al. |
| 5,117,562 | A | 6/1992 | Dulay et al. |
| 5,220,346 | A | 6/1993 | Carreira et al. |
| 5,396,270 | A | 3/1995 | Gooray et al. |
| 5,446,487 | A | 8/1995 | Russell et al. |
| 5,467,119 | A | 11/1995 | Richtsmeier et al. |
| 5,479,199 | A | 12/1995 | Moore et al. |
| 5,500,668 | A | 3/1996 | Malhotra et al. |
| 5,537,925 | A | 7/1996 | Secor et al. |
| 5,563,644 | A | 10/1996 | Isganitis et al. |
| 5,589,866 | A | 12/1996 | Russell et al. |
| 5,631,685 | A | 5/1997 | Gooray et al. |
| 5,757,407 | A | 5/1998 | Rezanka |
| 5,814,138 | A | 9/1998 | Fague |
| 6,146,770 | A | 11/2000 | Sargeant et al. |
| 6,231,176 | B1 | 5/2001 | Peter |
| 6,293,196 | B1 | 9/2001 | DeMoore et al. |
| 6,409,329 | B1 * | 6/2002 | King |

OTHER PUBLICATIONS

A.C. Metaxas, "Foundations of Electroheat", 1996, pp. 102–103.

* cited by examiner

*Primary Examiner*—Raquel Yvette Gordon

(57) ABSTRACT

An inkjet printer includes a microwave drying station passing media through a waveguide thereof. A vacuum source coupled to the waveguide draws air into the waveguide and thereby aides in disturbing and scrubbing a boundary layer of vapor at the media surface otherwise hindering efficient drying of media thereat. Supporting the media on a perforated belt through the waveguide couples media to the belt by vacuum force and thereby contributes to an overall media feed mechanism.

26 Claims, 8 Drawing Sheets

MICROWAVE APPLICATOR FOR INKJET PRINTER

BACKGROUND OF THE INVENTION

The present invention relates generally to printing methods and apparatus, and particularly relates to ink drying as applied in the context of inkjet printing operations.

Inkjet printing produces print imaging by propelling ink droplets onto media. A variety of inkjet printing apparatus have evolved, but generally share in the common characteristic of rendering an image by depositing liquid on a media substrate. As such, inkjet printing methods and operations sometime include or even require drying of media, i.e., drying liquid ink following application to media as print imaging.

Inkjet drying techniques include passing media including wet print imaging through heated rollers. Unfortunately, the application of heat energy and consequent drying to wet media when in a curved condition, i.e., as wrapped around a roller, often results in undesirable cockling and/or buckling or curvature of output. As a result, such media often suffers in quality and in some cases requires additional processing to "flatten" the media.

Use of microwave drying in an inkjet printing process is known. For example, U.S. Pat. No. 5,220,346 issued Jun. 15, 1993 and entitled Printing Process With Microwave Drying illustrates ink formulations and use of a microwave drying as applied in the context of inkjet printing. U.S. Pat. No. 5,563,644 issued Oct. 8, 1996 to Isganitis et al. and entitled Inkjet Printing Process with Microwave Drying also shows use of microwave radiation to dry ink in an inkjet printing context.

Generally, application of heat energy to wet ink volatilizes the ink and thereby dries print imaging produced thereby. Unfortunately, volatizing ink produces ink vapor which undesirably contaminates a printing operation and inhibits further drying. More particularly, volatilized ink compounds should be carried away from a printing operation so as to prevent excessive buildup of such compounds as volatilized or as settling back into liquid form. Thus, many ink drying methods and apparatus must carry away volatized ink compounds so as to avoid contamination of the printing operation. Accordingly, many ink drying methods and apparatus employ a separate system for carrying away and suitably venting volatized ink compounds. Volatilized ink compounds also inhibit further drying when accumulated at the media surface. In other words, volatized ink compounds tend to accumulate at a "boundary layer" of the media surface. This body of volatilized ink tends to prevent further volatilization of ink and thereby either inhibit or completely stop further drying of print imaging. Accordingly, ink drying methods and apparatus often "scrub" this boundary layer to remove a body of volatilized ink compounds from the media surface and thereby promote further productive drying of print imaging.

SUMMARY OF THE INVENTION

The present invention combines microwave heating apparatus and techniques with airflow techniques to improve overall ink drying in an inkjet printing operation. Microwave drying techniques, while effective, produce at the media surface a "boundary layer" of vaporized ink inhibiting or significantly impairing further productive drying thereat. The present invention incorporates airflow pathways within a microwave applicator to scrub this boundary layer and thereby promote more efficient drying by microwave radiation. In addition, the present invention, through use of selected air pathways in and about a heat zone, takes away undesirable ink vapors produced by the drying process and thereby eliminates need for separate apparatus dedicated specifically to ink vapor removal.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

Figure 1:
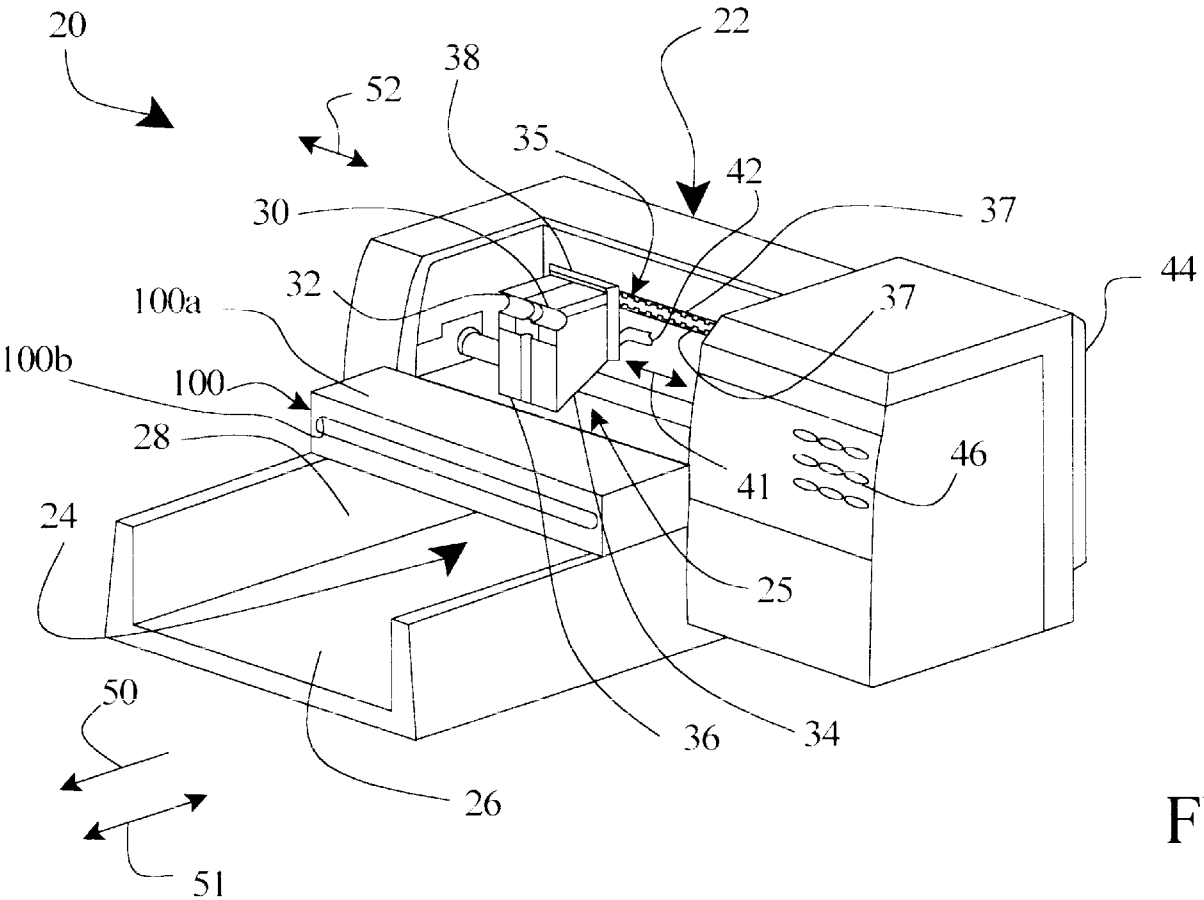
FIG. 1 illustrates in perspective a typical inkjet printer including a microwave applicator drying station according to a preferred embodiment of the present invention.

FIG. 1 illustrates a typical inkjet printing mechanism, specifically an inkjet printer 20. The present invention will be illustrated in the context of or as applied to a typical inkjet printing mechanism, e.g. in the context of or as applied to inkjet printer 20 of FIG. 1. It will be understood, however, that printer components and particular component architectures vary from model to model and that the present invention applies across a variety of specific inkjet printing mechanism implementations.

Printer 20 includes a chassis 22. Within chassis 22, a print media handling system 24 supplies sheets of media (not shown in FIG. 1) to the printer 20. Media may be of a variety of generally sheet-form materials, but will be referenced herein as paper or media for the purpose of describing the present invention. Handling system 24 moves media through a print zone 25 located along a feed path within chassis 22. The feed path begins at a feed tray 26 and ends at an output area 28. A variety of media transport mechanisms and techniques are known. Generally, such mechanisms and techniques include a picking device for collecting individual media from tray 26 and a set of various driven and pinch rollers propelling media along the feed path, through printer 20, and into output area 28.

As described more fully hereafter, the present invention concerns drying media following application of print imaging in print zone 25. As such, printer 20 operation will be described herein primarily with respect to media handling at or downstream from print zone 25, i.e., generally after application of print imaging to media therein.

In print zone 25, media moves longitudinally along the feed direction 50 and receives print imaging formed by projected ink droplets originating from a supply in a replaceable inkjet cartridge, such as a black inkjet cartridge 30 and/or a color inkjet cartridge 32. Generally, cartridges 30, 32, or "pens" as referenced by those familiar with the art, hold a selected ink formulation suitable for application to a selected media or particular print job. A variety of ink formulations has evolved across a variety of uses and variety of available media.

Cartridges 30 and 32 each carry a print head, individually referenced as print heads 34 and 36, respectively, projecting ink droplets toward print zone 25. Each print head 34 and 36, at its bottom surface, presents an orifice plate (not shown) with a plurality of nozzles formed therethrough. Combining replaceable ink cartridges with print heads is well known in the inkjet printing art and has contributed to the success of inkjet printers as industrial, office, and personal printers. Print heads 34 and 36, for example, are thermal inkjet print heads. Other types of print heads include piezoelectric print heads.

Print heads 34 and 36, implemented as thermal inkjet print heads, each include a plurality of resistors forming a resistive network associated with the print head nozzles. Energizing a selected resistor quickly heats ink near a nozzle opening and, suddenly, a bubble of gas forms. In this manner, an inkjet nozzle "fires." The bubble propels or ejects a droplet of ink at the nozzle, i.e. ink positioned between the nozzle opening and heated resistor. The droplet flies toward a sheet of media suitably positioned in print zone 25. Application of print imaging according to a given print job includes coordinating the position of cartridges 30 and 32 within print zone 25, coordinating the position of media within print zone 25, and "firing" the nozzle arrays within print heads 34 and 36 according to print imaging data.

A carriage 38 holds cartridges 30 and 32, along with the corresponding print heads 34 and 36, respectively. Carriage 38 reciprocates or "scans", i.e., moves laterally back and forth, through print zone 25. Positioning cartridges 30 and 32 during a print job includes controlled reciprocation through print zone 25 and along a scan axis 41 parallel to a lateral axis 52. A laterally-positionable carriage trolley 35 (shown partially) and a guide rod 40 establish movement of carriage 38 back and forth laterally through print zone 25. Guide rod 40 defines scanning axis 41 within print zone 25. More particularly, guide rod 40 is a rigid smooth-surfaced structure along which carriage 38 rides. Trolley 35 couples to carriage 38 and moves carriage 38 reciprocally back and forth through print zone 25. In this particular inkjet printer embodiment, trolley 35 includes a laterally disposed toothed belt 37 suspended between a driven gear (not shown) near one end of print zone 25 and an idling gear (not shown) at the opposite end of print zone 25. Thus, coupling carriage 38 to a point on belt 37 and driving belt 37 propels carriage 38 reciprocally as a trolley motor (not shown) alternates directions of rotation for belt 37.

Cartridges 30 and 32 selectively deposit one or more ink droplets on print media located in the print zone 25 in accordance with instructions received via a conductor strip 42 from a printer controller, such as a microprocessor which may be located within chassis 22 and indicated generally by reference number 44. Controller 44 may receive an instruction signal from a host device, which is typically a computer, such as a personal computer.

The print head carriage motor and the paper handling system drive motor operate cooperatively in response to printer controller 44 and in a manner well known to those skilled in the art. The printer controller 44 may also operate in response to user inputs provided through a keypad 46. A monitor coupled to the host computer may be used to display visual information to an operator, such as the printer status or a particular program being run on the computer. Personal computers, their input devices, such as a keyboard and/or a mouse device, and monitors are all well known to those skilled in the art.

As well appreciated in the art, ink droplets projected onto media in print zone 25 as liquid sometimes require drying to fully set print imaging produced thereby. Many ink formulations have been developed for improving drying time for inkjet printing applications. In additional to ink formulations, certain methods of printing have evolved to improve ink drying time in inkjet printing applications. Further, some inkjet printers include heating devices through which media pass following application of print imaging. Ink formulations, drying mechanisms, and printing techniques fully optimized for ink drying time, however, often present undesirable side effects. There typically exists some compromise between drying time and other print imaging quality requirements.

Thus, most inkjet printing operations improve by improving, i.e., reducing, dry time for ink-based print imaging without significantly compromising other print imaging quality requirements.

Thus, printer 20 operation improves by placing a drying station 100 following print zone 25. By incorporating a drying station 100 into printing operations conducted by printer 20, print imaging, i.e., liquid droplets deposited on media in print zone 25 more quickly achieve a suitably dry state for proper output from printer 20. In other words, printed output should reach a certain level of dryness before release from printer 20. Thus, drying station 100 applies heat energy to printed media just following, i.e., downstream from, print zone 25 and thereby more quickly promotes a suitably dry state thereof, i.e., suitably dry for release from printer 20 as output. Though illustrated as a component of printer 20, it will be understood that drying station 100 as described herein may be provided as a separate drying unit, i.e., a unit substantially as shown in FIGS. 2–9 and through which media may be fed after application of print imaging thereon. As described more fully hereafter, drying station 100 includes media transport mechanisms and thereby facilitates use as a separate unit, i.e., allows a user to insert media therein and automatically feed media therethrough while applying heat energy. As illustrated in FIG. 1, drying station 100 operates within a shroud 100*a*, releases output at slot 100*b*, and receives input at slot 100*c* FIG. 2. Further details of drying station 100, i.e., that located within shroud 100*a*, will be described more fully with reference to FIGS. 2–6.

Figure 2:
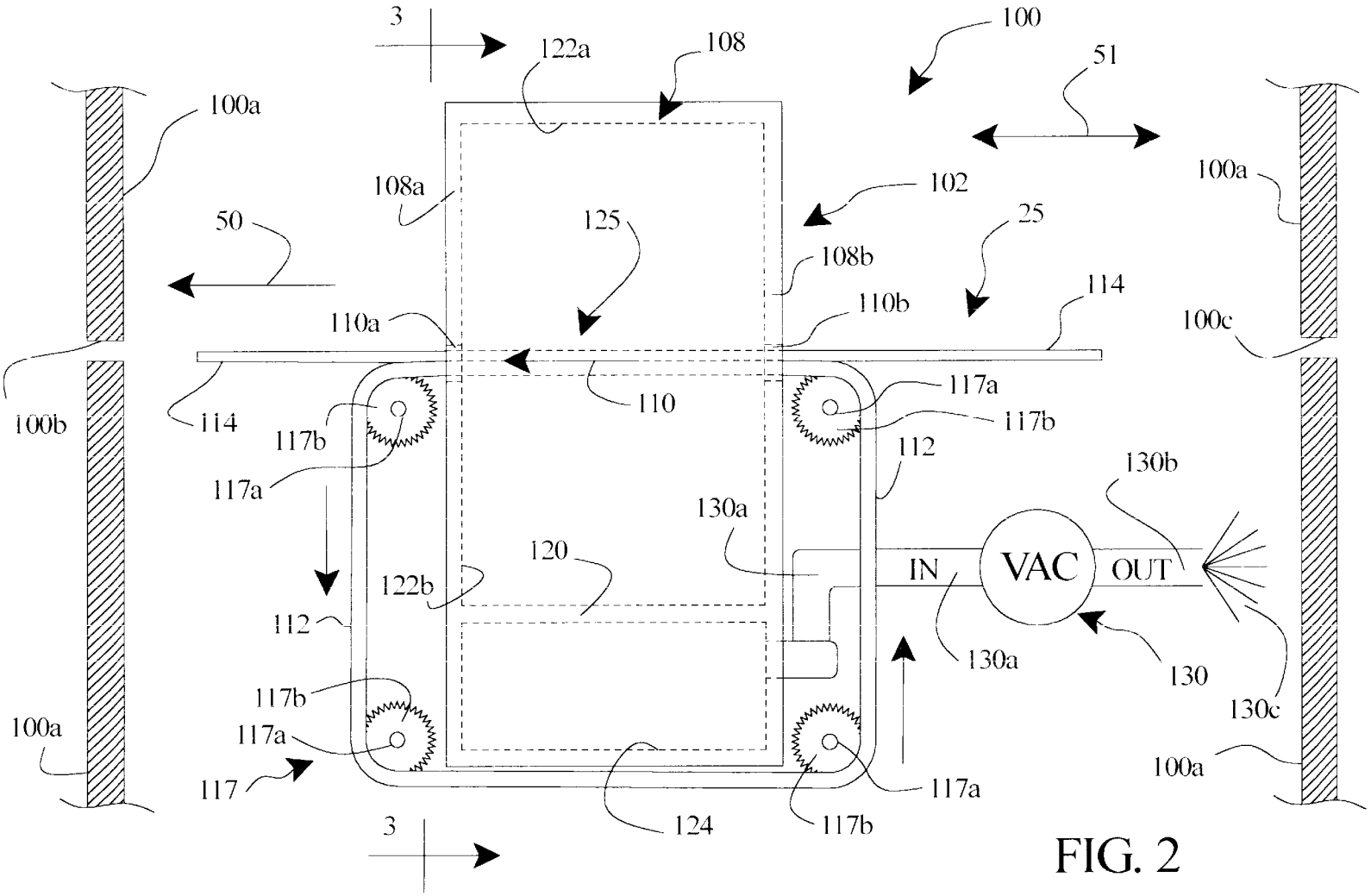
FIG. 2 illustrates, separately from the printer of FIG. 1, the microwave applicator drying station of FIG. 1.
Figure 3:
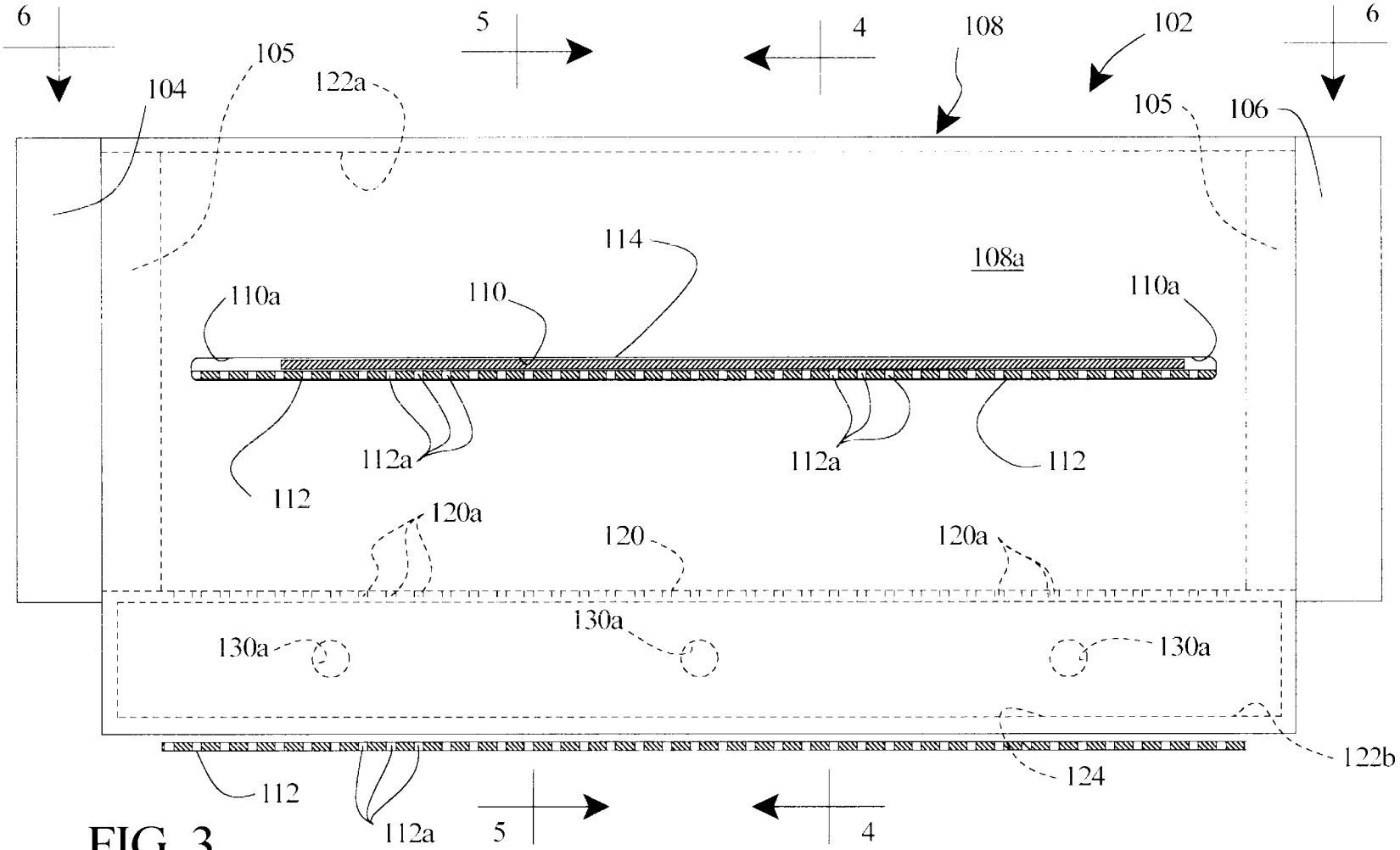
FIG. 3 illustrates the microwave applicator drying station of FIG. 2 as taken along lines 3—3 of FIG. 2.
Figure 4:
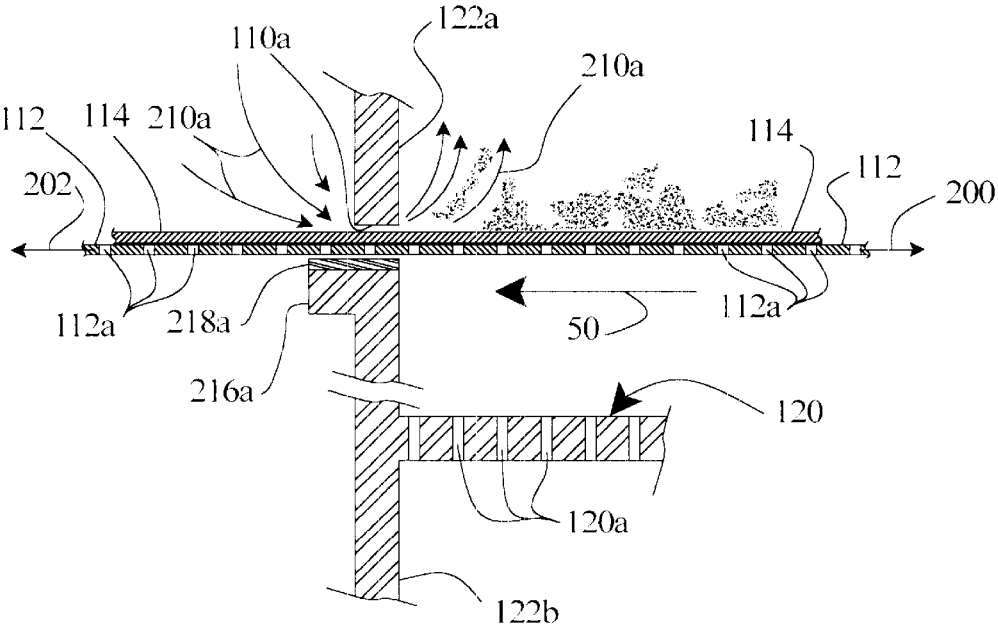
FIG. 4 illustrates partially and in section a portion of the microwave applicator drying station of FIG. 3 as taken along lines 4—4 of FIG. 3.
Figure 5:
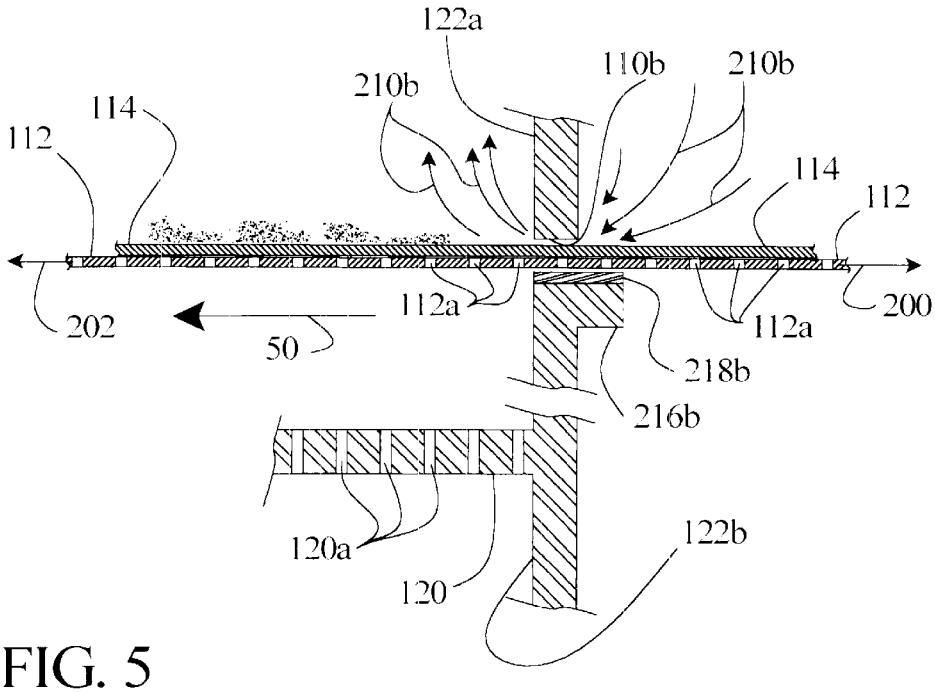
FIG. 5 illustrates partially and in section a portion of the microwave applicator drying station of FIG. 3 as taken along lines 5—5 of FIG. 3.
Figure 6:
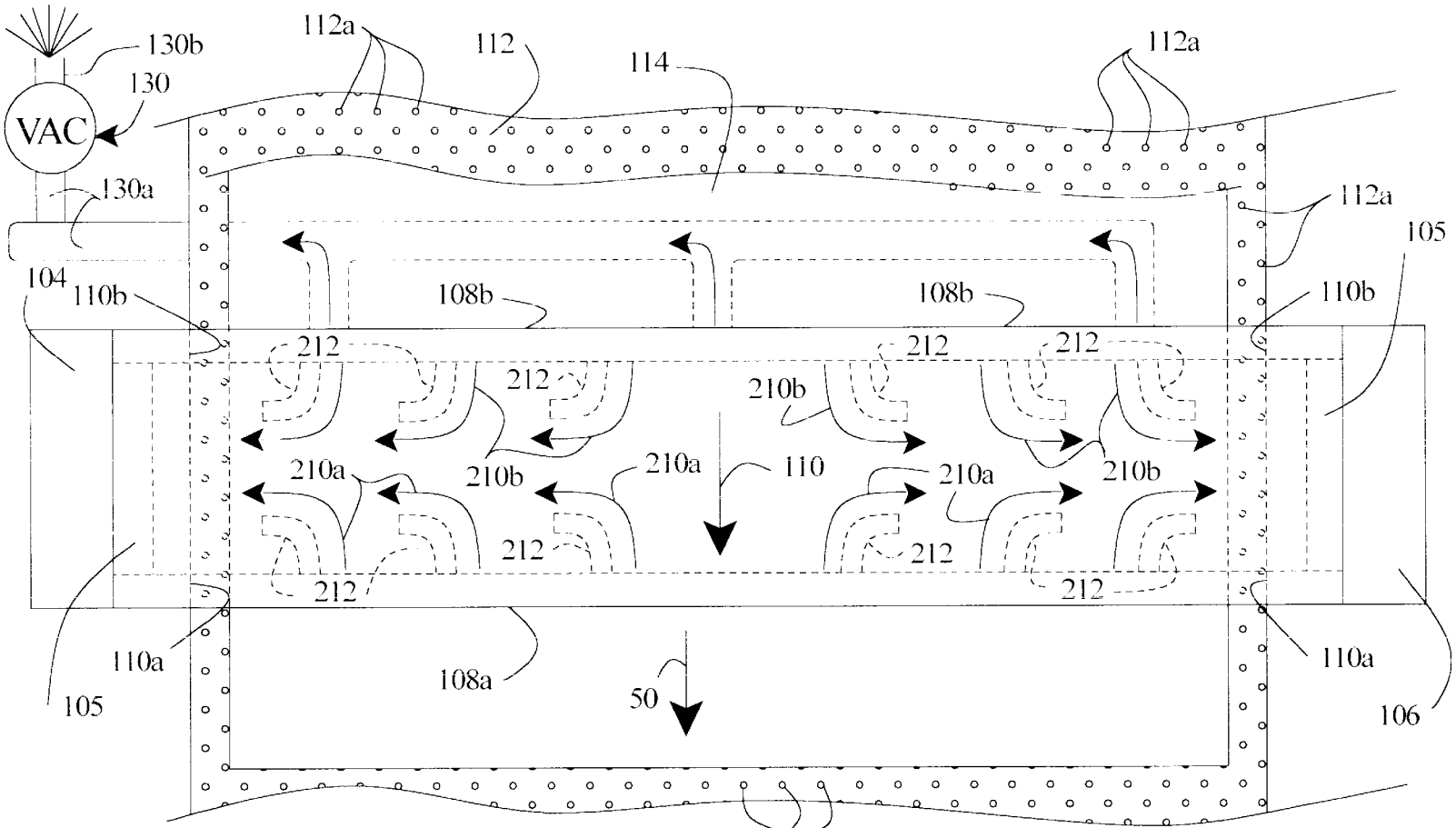
FIG. 6 illustrates the microwave applicator drying station of FIG. 3 as taken along lines 6—6 of FIG. 3.

FIGS. 2–6 illustrate in more detail various views of drying station 100 as separated from the remaining portions of printer 20. Shroud 100*a*, shown only partially in FIG. 2, may be provided to surround the components of drying station 100 as illustrated in FIGS. 2–6 and include front and rear slots 100*b* and 100*c* for passing media 114 therethrough. Thus, FIG. 2 illustrates drying station 100 components within shroud 100*a*. FIG. 3 illustrates a front view of drying station 100 as taken along lines 3—3 of FIG. 2. FIGS. 4 and 5 are partial sectional views showing air inflow at slot formations in the microwave applicator 102 of drying station 100. FIG. 6 is a top view of the microwave applicator as taken along lines 6—6 of FIG. 3.

Applicator 102 includes a microwave source 104 and a water load 106 coupled together by way of waveguide 108. Waveguide 108 is, in essence, a rectangular extrusion structure such as may be formed by extrusion. For example, aluminum extruded as a waveguide for microwave applicators is known. In operation, microwave source 104, e.g., a magnetron, directs radiant microwave energy toward water load 106 along waveguide 108. Waveguide 108 includes a longitudinal pathway 110 therethrough. More particularly, pathway 110 comprises a slot 110*a* in a front-facing wall 108*a* of waveguide 108 and a slot 110*b* in a rear-facing wall 108*b* of waveguide 108. Thus, longitudinal pathway 110 allows passage of media 114 through applicator 102 generally along axis 51 and in the media feed direction 50.

Microwave applicators similar to, but not identical to, applicator 102 are commercially available. Generally, magnetrons and waveguides are available from many manufacturers according to well-established standards and known modes of operations. For example, manufacturers typical of such providers include Cober-Mugge and Toshiba. Many different companies offer microwave magnetrons and waveguides ready for use in a variety of applications. The present invention may be implemented by use of many of these microwave applicators by incorporating into such devices collection of air, e.g., by coupling the waveguide to a vacuum source.

A belt 112 carries media 114 along pathway 110 and through waveguide 108 for drying of print imaging just applied in print zone 25. FIG. 2 illustrates the relative position of print zone 25, i.e., an upstream position relative to applicator 102. In practice, a useful distance between print zone 25 and applicator 102 is on the order of 50 mm, i.e., the rear slot 110*b* of applicator 102 being located approximately 50 mm from print zone 25 along the feed direction 50.

Belt 112 is a perforated belt and includes a drive mechanism 117 propelling belt 112 along pathway 110, i.e., along the feed direction 50. As belt 112 passes along pathway 110 of waveguide 108, it carries thereon media 114 as collected from print zone 25 of printer 20. Belt 112 may be constructed from a variety of materials depending on a particular implementation of the present invention. Because belt 112 passes through waveguide 108, it should withstand the microwave energy passing therealong. In this regard, belt 112 could be microwave "transparent" to minimize its interaction with microwave energy passing through waveguide 108. Alternatively, the composition of belt 112 may be taken into account in the heating aspects provided by drying station 100. More particularly, a metallic or partially metallic belt 112 will heat within the waveguide 108 and thereby contribute to application of heat energy to media 114 resting thereon. As will be discussed more fully hereafter, perforations 112*a* in belt 112 in combination with application of vacuum to selected portions of microwave applicator 102 enable belt 112 to engage media 114 by vacuum force and thereby serve as a media feed mechanism.

Belt drive mechanism 117 may be provided according to a variety of architectures depending on relative positioning of various components and constraints such as minimum belt 112 radius of curvature allowed. While illustrated herein as being supported on four separate shafts 117*a* and corresponding gears 117*b* carried thereon, it will be appreciated that other arrangements may be provided including a similar loop-architecture, but including only two shafts 117*a* and a set of larger-diameter gears or rollers on each shaft 117*a*. The upward-facing portion of belt 112 carrying media 114 thereon, may be extended rearward and into print zone 25 as necessary to accommodate integrated media support therethrough or to accommodate larger-diameter, and fewer, rollers or gears 117*b*.

In any case, belt 112 is perforated at apertures 112*a* and includes an upward-facing portion moving along passageway 110 and supporting media 114 thereon. Generally, belt 112 should be maintained in tension through pathway 110 and should be of width greater than media 114 resting thereon. Maintaining belt 112 in tension through pathway 110 creates a flat surface upon which media 114 rests during the drying process. As a result, media 114 dries in a flattened condition and thereby possesses less curl or buckling as is often found in other drying systems, e.g., such as systems drying media while in a curved condition.

Applicator 102 includes along waveguide 108 a perforated floor 120. Floor 120 includes an array of apertures 120*a*. Pathway 110 bifurcates waveguide 108 into an upper chamber 122*a* and a lower chamber 122*b*. A vacuum chamber 124 is located below floor 120. Vacuum chamber 124 couples fluidly to lower chamber 122*b* by way of apertures 120*a*. A vacuum source 130 couples to lower chamber 124 and draws air therefrom. This in turn draws air from lower chamber 122*b* by way of perforations 120*a* in floor 120. An inlet conduit 130*a* couples chamber 124 and vacuum source 130. An outlet conduit 130*b* couples to an exhaust 130*c*. Inlet conduit 130*a* routes around belt 112, e.g., taken from the back wall 108*b* of waveguide 108 and routed along behind and then around belt 112. As will be described more fully hereafter, vacuum source 130 collects from waveguide 108 vaporized ink as taken from the drying process occurring within the heat zone 125 of waveguide 108. Accordingly, vacuum source 130, as fluidly coupled to the interior of waveguide 108, collects undesirable vaporized ink material and conveys such material to exhaust 130. No separate ventilation system need be included to carry away undesirable ink vapors. Manipulating the distribution and size of perforations 120*a* in combination with controlling the magnitude of vacuum applied to vacuum chamber 124 provides opportunity to control the magnitude of airflow from upper chamber 122*a* into lower chamber 122*b* as well control the relative air pressures therebetween. In practice, apertures 120*a* can be 1–3 mm in diameter and distributed throughout floor 120. Generally, apertures 120 should be large enough to prevent significant vacuum differential between upper chamber 122*a* and lower chamber 122*b* when no media 114 rests on belt 112 within applicator 102.

With pathway 110 situated intermediate chambers 122*a* and 122*b*, air drawn from waveguide 108 and into vacuum chamber 124 originates exterior of waveguide 108. More particularly, air drawn out of applicator 102 by means of vacuum 130 originates at slots 110*a* and 110*b* of applicator 102, i.e., taken from ambient air surrounding applicator 102. With no media resting on belt 112, no significant vacuum differential exists between chambers 122*a* and 122*b*. With media 114 resting on belt 112, however, many of the apertures 112*a* are closed by media 114. As a consequence, a significant pressure differential develops between upper chamber 122*a* and lower chamber 122*b*. More particularly, a negative pressure develops in lower chamber 122*b* and a relatively less negative pressure develops in upper chamber 122*a*. As a result, media 114 is held by vacuum force against the upward-facing surface of belt 112. Furthermore, airflow taken from applicator 102 includes vaporized ink as scrubbed away from media 114 and carried away from the drying station 100 by vacuum source 130. In this maimer, applying a vacuum source to a microwave applicator according to the present invention both provides assistance in media transport as well as vapor transport, i.e., taking-away undesirable ink vapors.

Microwave transparent non-porous end caps 105, e.g., quartz plates, seal each end of waveguide 108. More particularly, caps 105 mount at each end of upper chamber 122*a* and lower chamber 122*b*. These microwave transparent end caps are positioned in face-to-face relation to the microwave source 104 and microwave load 106. End caps 105 should be non-porous, i.e., create an air-tight seal at the ends of waveguide 108. In this manner, vacuum applied to the interior of waveguide 108 results in airflow into applicator 102 only at slots 110*a* and 110*b*. In other words, end caps 105 provide air-tight seals for the otherwise tubular structure of waveguide 108. Because most microwave applicators do not make use of vacuum forces applied thereto, such microwave transparent end caps are typically not found in conventional microwave applicators.

Thus, application of vacuum at or near the under surface of perforated belt 112 draws media 114 onto belt 112. Belt 112 thereby "grabs" media 114 by vacuum force and constitutes, at least with respect to that portion of belt 112 within applicator 102, a media-engaging and media-propelling transport belt. In other words, as belt 112 and media 114 pass through applicator 102, that length of belt 112 and media 114 within applicator 102 couple together by vacuum force. Belt 112,as incorporated into printer 20, contributes to the overall printer 20 feed mechanism by propelling media 114 through applicator 102 and into ouput area 28. As such, upstream media feed mechanisms, e.g., of printer 20, need only advance media sufficiently past print zone 25 to reach station 100. When used as an independent drying station, a user need only insert the leading edge of media into rear slot 110*b*. Belt 112 then engages and transports media through applicator 102 by vacuum grip. Important to note, the coupling between media 114 and station 100 is a "non-contact" coupling with respect to the upper-facing side of media 114. In other words, station 100 does not contact and thereby avoids degrading print imaging just-applied in print zone 25 and not yet set, i.e., not yet sufficiently dry, to prevent smudging by contact.

Application of heat energy to media containing liquid ink vaporizes and thereby dries print imaging formed by the ink. Unfortunately, this process can be self-defeating due to formation of a "boundary layer" of vapor at the surface of the drying media. In other words, upon vaporization the ink tends to hang in vapor form just above the surface of media 114. As a consequence, this inhibits, or in some cases completely stops, further vaporization of ink and thereby stops further productive drying of print imaging. As a result, the boundary layer must be "scrubbed" to remove a body of stagnant ink vapor thereat.

Air inrush 210 at slots 110*a* and 110*b* in the vicinity of such a boundary layer breaks up and scrubs the boundary layer and thereby exposes for further vaporization remaining ink on the media surface yet to be vaporized. FIGS. 4–6 illustrate such airflow in more detail. In FIGS. 4–6, belt 112 moves in the feed direction 50, but is maintained in tension and flat by means of a rearward directed force 200 being less than a forward directed force 202. For example, drive mechanism 117 should include sufficient horizontal bias between supports, e.g., rollers or gears 117*b*, holding that portion of belt 112 within guideway 108 to maintain belt 112 and media 114 resting thereon in a well-flattened condition. With particular reference to FIG. 4, air inrush 210*a* along the upper edge of slot 110*a* enters upper chamber 122*a*. Preferably, air inrush 210*a* into chamber 122 is primarily above belt 112 and media 114. Accordingly, waveguide 108 may be fitted with a flange or lip 216*a* along the bottom edge of slot 110*a* and include thereon a Teflon™ plate 218*a*. Belt 112 slides over plate 218*a*. Preferably, this creates to some extent a seal along the bottom edge of slot 110*a* relative to belt 112. The gap 220*a* between the top edge of slot 110*a* and the upper-facing surface of media 114 can be minimized to produce more velocity in air inflow 210*a* and greater "scrubbing" of media 114 as it leaves drying station 100.

FIG. 5 illustrates a sectional view similar to FIG. 4, but showing air inrush 210*b* at slot 110*b* and a Teflon™ plate 218*b* on lip 216*a* along the bottom edge of slot 110*b*. Air inrush 210*b* comes into waveguide 108 at the initial formation of ink vapors in the boundary layer, and thereby contributes desirably to turbulence therein. In contrast, air inrush 210*a* at slot 111*a* substantially scrubs entirely the boundary layer at its most complete state of formation, i.e., as media 114 leaves drying station 100 a boundary layer of ink vapor is at its maximum, but scrubbed away by air inrush 210*a*. As a result, media 114, still holding heat energy, can more readily vaporize any remaining ink from print imaging held thereby just as the boundary layer is scrubbed off at slot 110*a*.

Microwave transparent ribs or louvers 212 (FIG. 6) direct airflow within waveguide 108. In other words, microwave transparent structures 212 may be incorporated within applicator 102, more particularly within waveguide 108, to better direct airflow therein without interfering with microwave transmission therethrough.

Apertures 120*a* in floor 120 and apertures 112*a* in belt 112, as well as louvers 212, establish an overall airflow pattern. Controlling various air pressures and airflow magnitudes can be accomplished by relative sizing of apertures 112*a* and apertures 120*a* as well as potentially including dams as sidewalls for path 110 through waveguide 108. In other words, walls abutting the edges of belt 112 force more air, or a controlled greater amount of air, through apertures 112*a* in belt 112. Variation in dam size will vary the amount of airflow reaching apertures 120*a* directly or reaching apertures 120*a* by way of apertures 112*a*.

Figure 7:
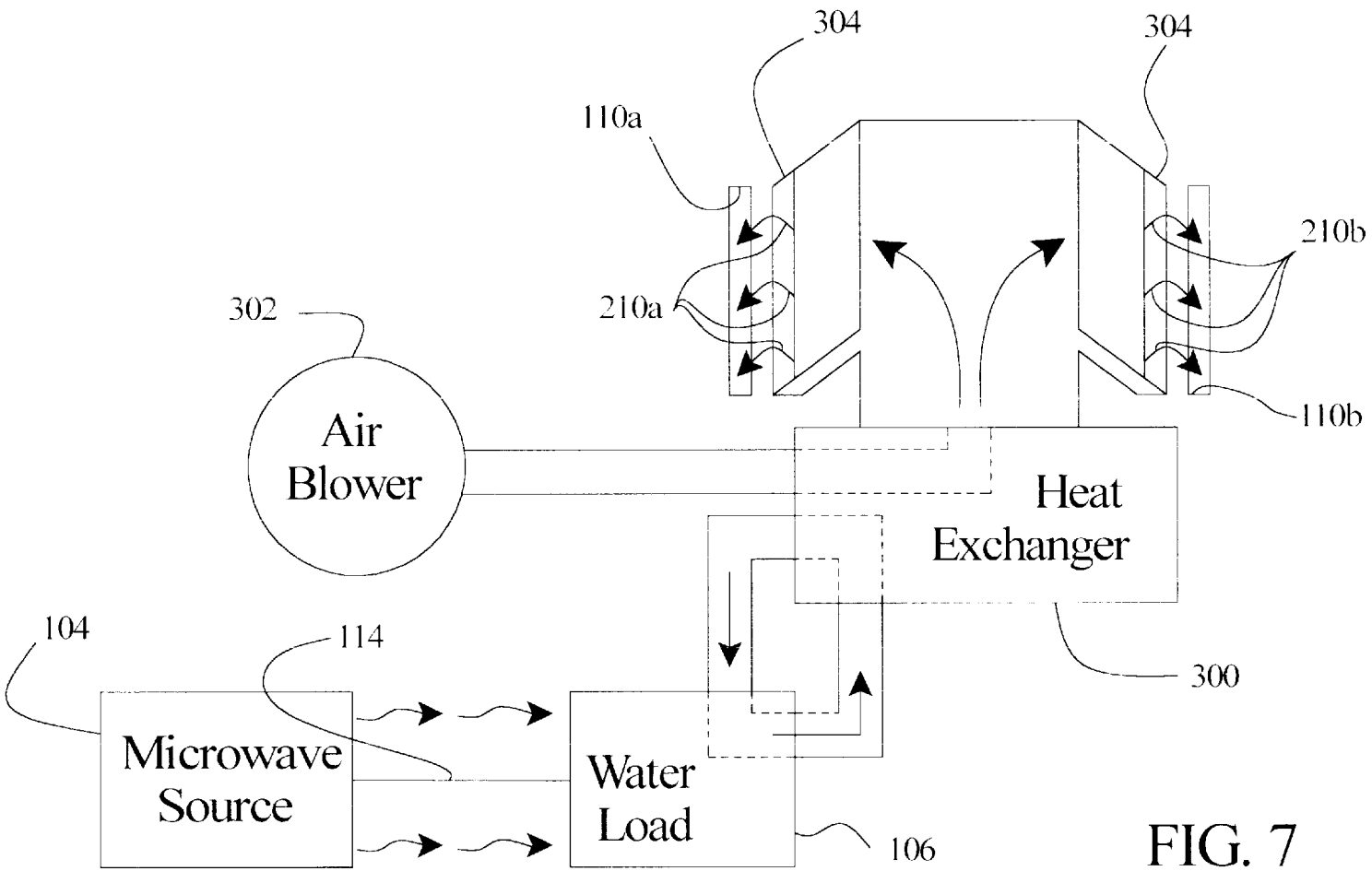
FIGS. 7 and 8 illustrate schematically alternative or combinable forms of the microwave applicator drying station of FIGS. 1–6 including use of a heat exchange and/or heat recycling in operation thereof.

FIG. 7 illustrates use of a heat exchanger 300. Generally, water in the load 106 is circulated through the heat exchanger 300. An air blower 302 forces air through heat exchanger 300 and thereby takes-away heat energy from water load 106. Heat energy taken from the heat exchanger 300 is then applied to the slots 110*a* and 110*b*, e.g., such as by providing outlet vents 304 in the vicinity of slots 110*a* and 110*b*. Thus, a heated source for air inrush 210*a* and 210*b* at slots 110*a* and 110*b*, respectively, may be provided by vents 304. In this manner, heat developed during the drying process is conserved by recycling heat energy back into applicator 102.

Figure 8:
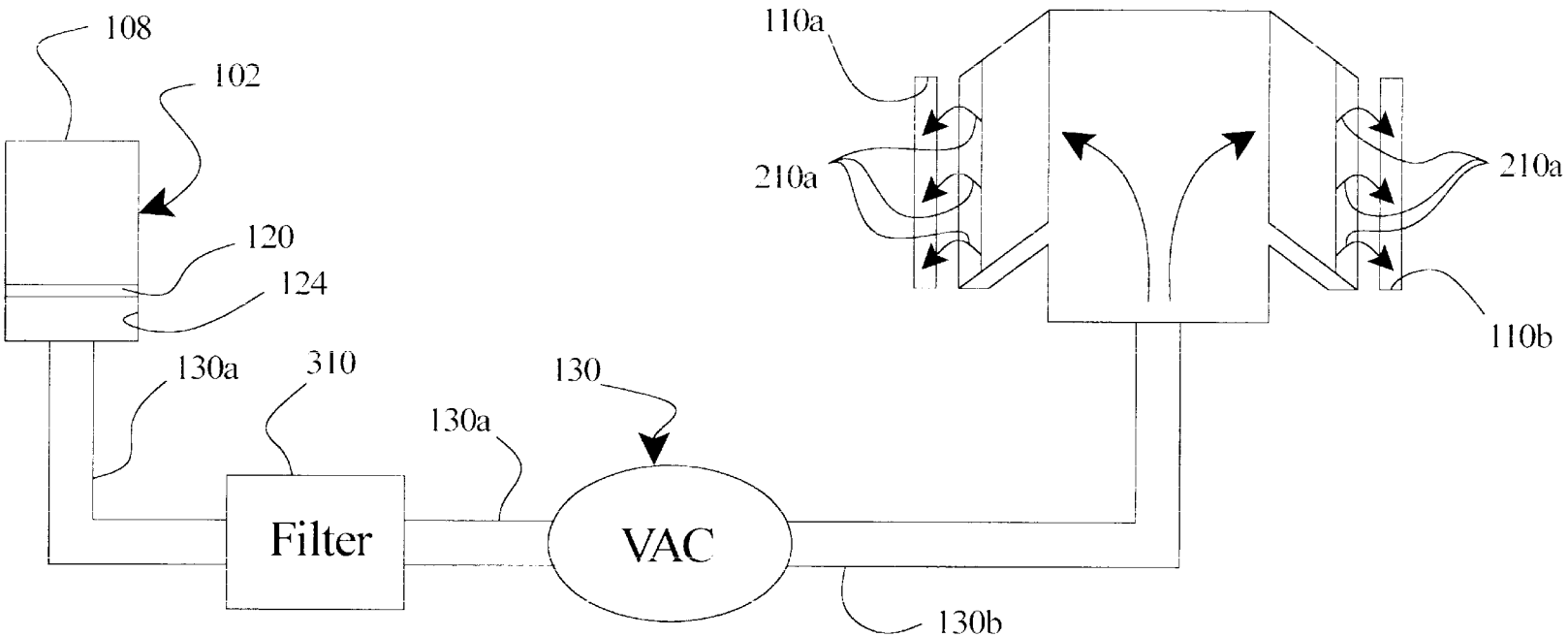

FIG. 8 illustrates use of heat recycling by taking air from applicator 102, filtering such air at filter 310, applying such air to vacuum 130, and directing the exhaust 130*c* from conduit 130*b* of vacuum 130 into slots 110*a* and 110*b* of applicator 102. In this manner, vaporized ink collected from applicator 102 is removed from the airflow entering vacuum source 130 by means of filter 310 as interposed between vacuum source 130 and applicator 102, i.e., along conduit 130*a*. The exhaust conduit 130*b* taken from vacuum source 130 thereby holds significant heat energy as taken from applicator 102. Directing such heated air back for uptake as inrush 210*a* and 210*b* at slots 110*a* and 110*b*, respectively, conserves heat energy and further enhances ink drying.

Figure 9:
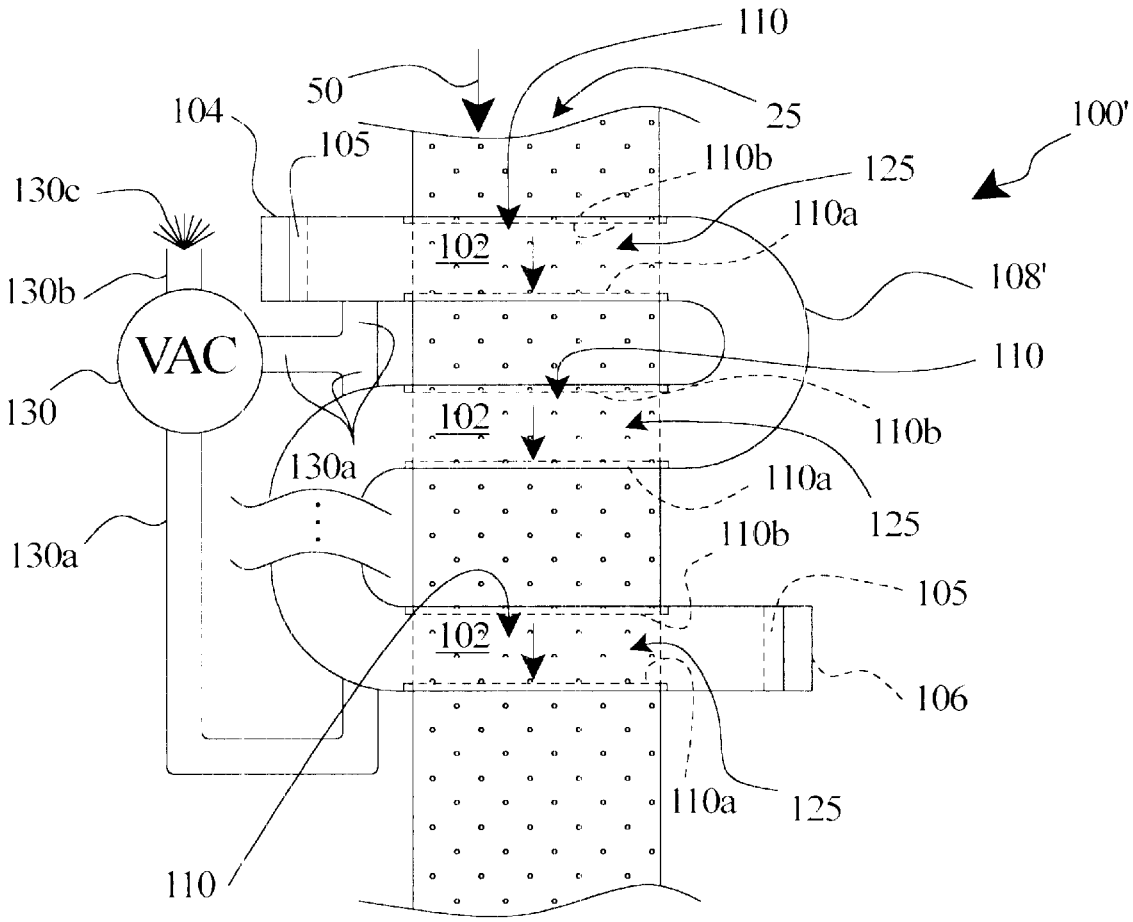
FIG. 9 illustrates an alternative form of microwave applicator under the present invention organized as a serpentine waveguide with multiple heat zones and scrubbing zones provided thereby.

FIG. 9 illustrates a serpentine waveguide 108' as a series of applicators 102 interconnected by means of 180 degree waveguide turns. This establishes a larger drying station 100' including a series of heat zones 125 along feed path 50. In FIG. 9, a series of applicators 102 lie transverse to feed path 50 as described herein above. An overall serpentine waveguide 108' is established by coupling applicators 102 by 180 degree waveguide turns. Thus, pathways 110 for each applicator 102 align and belt 112 passes through each of slots 110*a* and 110*b* therealong. Vacuum 130 couples to various portions of waveguide 108' to draw vaporized ink therefrom and to couple together media resting on belt 112 as described above. While not specifically illustrated in FIG. 9, it will be understood that a vacuum chamber below waveguide 108' couples to the remainder of waveguide 108' by means of a perforated floor, e.g., similar to floor 120 as described herein above. Vacuum 130 thereby pulls from waveguide 108' vaporized ink. Furthermore, air taken into waveguide 108' enters waveguide 108' at slots 110*a* and 110*b* of each applicator 102. As a result, media passing through the series of applicators 102 receives significant scrubbing action at each of slots 110*a* and 110*b* as it moves along an overall feed path 50 therethrough.

Generally, in operation a variety of parameters may be adjusted to achieve an overall desired drying of media 114. Thus, variation in the number of and size of apertures 120*a* and 112*a* as well as an overall magnitude of vacuum force applied will establish the basic air pressure differentials and airflow needed. Also, various ink formulations may be used to facilitate more rapid drying by microwave radiation. Finally, multiple applicators may be employed, e.g., such as a serpentine waveguide 108' as illustrated in FIG. 9, to increase the amount of heat energy applied to a given media 114. Depending on design specifications, i.e., how quickly one wishes to dry media 114 and/or how many passes through drying station 100 are acceptable, one can manipulate the amount of power applied to source 104, amount of vacuum pressure, speed of belt 112, type of ink used, and distribution and size of apertures 120*a* and 112*a* to achieve an overall drying time and number of drying passes objective.

Thus, an improved inkjet drying station has been shown and described. Drying moisture from inkjet media requires a heat source to raise temperature of the ink, a mass transfer system to remove vapors and scrub the boundary layer, and a non-contact media transport system to move media through the dryer. In accordance with the present invention, all three systems required for inkjet media drying are provided in the drying station 100 as described herein. Drying station 100 combines all three systems, i.e., heating, vapor transport, and non-contact media transport, into one compact system using less power and area to complete the same task. The microwave chamber or waveguide 108 may be provided in a relatively narrow dimension, e.g., on the order of 2 inches, along axis 51, i.e., along the media feed direction 50. This saves space and time. Because the applicator is substantially enclosed, this provides a closed volume, i.e., chambers 122*a* and 122*b*, to use as a vacuum chamber. Pulling the vacuum from the bottom chamber 122*b* creates a "paper-transport" capable vacuum belt. For proper operation, sizing the air passages on the sides of the belt allows minimal airflow and creates a pressure differential between the top and bottom of belt 112. This not only traps ink vapors which are generally difficult to control in traditional drying systems, but also provides a mechanism sweeping away the ink vapors in controlled fashion. This effectively eliminates the need for a separate vapor collection system as is often found in traditional inkjet drying stations. Furthermore, because the vacuum pulls air across the media, the present invention scrubs the boundary layer of the media and thereby promotes more efficient drying rates. Finally, the vacuum established in applicator 102 reduces pressure over the area being dried, this reduced pressure decreases the boiling point for ink on the media therein and thereby increases drying rates.

It will be appreciated that the present invention is not restricted to the particular embodiment that has been described and illustrated, and that variations may be made therein without departing from the scope of the invention as found in the appended claims and equivalents thereof.

What is claimed is:

1. In combination:

an inkjet printer producing print imaging by application of liquid ink droplets to media in a print zone;

a microwave drying station, said microwave drying station including a waveguide chamber receiving said media therethrough; and a vacuum source coupled to said waveguide chamber, said vacuum source drawing air from said waveguide chamber.

2. A combination according to claim 1 wherein said waveguide chamber comprises a perforated floor, said vacuum source being coupled to said waveguide chamber at said perforated floor.

3. A combination according to claim 2 wherein said vacuum source draws air from said waveguide chamber through said apertures of said perforated floor and into a vacuum chamber.

4. A combination according to claim 1 wherein said microwave drying station includes a waveguide, said waveguide including an upper chamber and a lower chamber, a media pathway permitting passage of media therethrough and separating said upper and lower chambers, said lower chamber being coupled to said vacuum source.

5. A combination according to claim 4 wherein said upper chamber and said lower chamber are separated by a perforated belt.

6. A combination according to claim 5 wherein said perforated belt includes perforations therein selected to establish a given relative air pressure between said upper chamber and lower chamber.

7. A combination according to claim 4 wherein said microwave drying station includes a microwave source and a microwave load, said upper chamber and said lower chamber each coupling together said microwave source and said microwave load.

8. A combination according to claim 1 wherein said drying station includes a media transport belt passing through said waveguide, said belt including apertures therein, said media resting thereon.

9. A combination according to claim 8 wherein said belt is propelled by a belt drive mechanism to move through said waveguide, said belt being positioned to permit airflow therethrough as a function of said vacuum source being coupled to said waveguide.

10. A combination according to claim 1 wherein said microwave drying station includes a magnetron and a water load, said waveguide coupling said magnetron and said load.

11. A combination according to claim 1 wherein said waveguide includes microwave-transparent end caps, said end caps being non-porous and preventing air intake therethrough and thereabout.

12. A drying station for an inkjet printer, said drying station comprising:

a microwave applicator including a waveguide, said waveguide being a bifurcated waveguide including a first chamber and a second chamber, said waveguide including a pathway therethrough, said first and second chambers being separated by a perforated structure therebetween;

a vacuum source; and a conduit coupling said vacuum source to said second chamber.

13. A drying station according to claim 12 wherein said perforated structure is a perforated belt movable along said pathway.

14. A drying station according to claim 12 wherein said drying station is positioned downstream of a print zone for said printer.

15. A drying station according to claim 12 wherein said drying station comprises a drying station unit separate from a printer applying print imaging to media dried thereby.

16. A drying station according to claim 12 wherein relative sizing of apertures of said perforated structure and magnitude of vacuum applied by said vacuum source achieves a selected relative air pressure between said first chamber and said second chamber.

17. A drying station according to claim 16 wherein said selected relative air pressure establishes vacuum force engagement between media resting on said perforated structure and originating from said vacuum source.

18. A drying station according to claim 12 wherein said drying station further comprises a belt transport mechanism moving said perforated structure along said pathway in a feed direction.

19. A drying station according to claim 12 wherein said drying station includes a belt drive mechanism propelling said perforated structure along said pathway, said perforated structure being positioned to permit airflow as a function of said vacuum source being coupled to said first chamber.

20. A drying station according to claim 12 wherein said first chamber is an upper chamber and said second chamber is a lower chamber of said waveguide.

21. A drying station according to claim 12 wherein said microwave applicator includes a microwave source and a microwave load, said first chamber and said second chamber each coupling together said microwave source and said microwave load.

22. A drying station according to claim 12 wherein said microwave applicator includes microwave transparent end caps.

23. A drying station for an inkjet printer, said drying station comprising:

a microwave source;

a microwave load;

a waveguide coupling said microwave source and said microwave load; and a vacuum source coupled to said waveguide and drawing from said waveguide ink vapors produced thereby.

24. A drying station according to claim 23 wherein said waveguide is a slotted waveguide providing a pathway therethrough.

25. A drying station according to claim 23 wherein said waveguide is a bifurcated waveguide including a first chamber and a second chamber, said chamber being separated by perforated media-supporting structure.

26. A drying station according to claim 23 wherein said waveguide is a slotted waveguide providing a media pathway therethrough, said waveguide being a bifurcated waveguide having a first chamber and a second chamber separated by said pathway therebetween, said vacuum source being applied to said second chamber.

* * * * *